United States Patent [19]

Shawler

[11] Patent Number: 4,899,888

[45] Date of Patent: Feb. 13, 1990

[54] ADJUSTABLE PACKING CARTON FOR TRANSPORTATION OF RECTILINEAR ARTICLES

[75] Inventor: Ralph H. Shawler, Prospect, Ky.

[73] Assignee: Packaging Service Corporation of Kentucky, Louisville, Ky.

[21] Appl. No.: 212,265

[22] Filed: Jun. 27, 1988

[51] Int. Cl.[4] ..... B65D 5/42; B65D 85/30

[52] U.S. Cl. ..... 206/586; 206/453; 206/521

[58] Field of Search ..... 206/586, 521, 594, 453

[56] References Cited

U.S. PATENT DOCUMENTS

| | | | |
|---|---|---|---|
| 1,613,152 | 1/1927 | Agar . | |
| 1,783,570 | 12/1930 | Hill . | |
| 2,005,967 | 6/1935 | Berdan | 206/62 |
| 2,068,771 | 1/1937 | Sherman | 206/586 |
| 2,160,221 | 5/1939 | Masters et al. | 229/14 |
| 2,555,126 | 5/1951 | Greve | 62/31 |
| 2,589,604 | 3/1952 | Cunningham et al. | 206/62 |
| 2,670,122 | 2/1954 | Davidson et al. | 229/DIG. 1 |
| 2,746,667 | 5/1956 | Murphy | 229/14 |
| 2,950,001 | 8/1960 | Bucko | 206/586 X |
| 2,950,038 | 8/1960 | Rupp | 206/586 X |
| 2,979,246 | 4/1961 | Liebeskind | 229/14 |
| 3,146,932 | 9/1964 | Mayer | 206/521 X |
| 3,302,782 | 2/1967 | Pezely | 206/62 |
| 3,344,973 | 10/1967 | Studen | 229/37 |
| 3,536,245 | 10/1970 | Palmer | 206/586 |
| 3,615,006 | 10/1971 | Freed | 206/62 |
| 3,939,978 | 2/1976 | Thomaswick | 206/454 |
| 4,162,729 | 7/1979 | Kaiser et al. | 206/592 |
| 4,436,307 | 3/1984 | Caldwell | 273/157 R |

*Primary Examiner*—Arnold Rosenthal

*Attorney, Agent, or Firm*—Davis Hoxie Faithfull & Hapgood

[57] ABSTRACT

A corrugated cardboard packing carton for the transportation of rectilinear articles is provided with cushioned pads to support the lower and upper planar surfaces of the article being transported to protect it from impact. Inserts at each corner of the carton support the article at its edges. The inserts are pre-cut so that portions may be removed to adjust the width of each insert to the exterior size of the article being transported, allowing a single size carton to be used in the packaging of articles of differing dimensions.

28 Claims, 3 Drawing Sheets

ADJUSTABLE PACKING CARTON FOR TRANSPORTATION OF RECTILINEAR ARTICLES

FIELD OF THE INVENTION

This invention relates to an adjustable packing carton for transporting generally flat, rectilinear articles of various sizes such as framed pictures. More specifically, it relates to a padded carton with interior corner inserts, the size and configuration of which inserts can be quickly and easily modified to adapt to the exterior dimensions of the article to be transported. The invention also constitutes a packing or shipping kit comprising an outer carton, adjustable sized corner inserts, pads for cushioning the front and rear surfaces of the article to be shipped and a carry handle.

BACKGROUND OF THE INVENTION

The transportation of large rectilinear articles, such as framed pictures or mirrors, requires special care and attention, since these articles are generally fragile. These articles are commonly set within a carton with their exterior edges spaced from the interior walls of the carton. Shock or impact absorbing materials are utilized in the space between the exterior edges of the article and the interior walls of the carton to cushion and protect the article from impact and damage during transportation and handling.

Inserts that are L-shaped have been utilized in the oorners of cartons to provide protection from impact. For instance, in U.S. Pat. No. 2,160,221, a protective corner pad is disclosed. The disclosed pad is constructed from sections of corrugated cardboard which are folded over each other. The size of the pad is, therefore, determined by the exterior dimension of the article to be transported, and is fixed during its construction by folding additional layers of cardboard. To modify the size of the pad when packaging the article, however, would require that a section of cardboard be scored in the appropriate locations and then the pad cut, folded and adjusted at the time of packaging, adding additional time, labor and expense to the packaging process.

In U.S. Pat. No. 3,302,782, a corner pad is disclosed the size of which is adjusted during the construction of the pad. This adjustment, therefore, requires prior knowledge of the specific dimensions of the article to be packaged and the disclosed corner pad in combined use with a container of specific size, can effectively be used to package articles of only a single size.

In U.S. Pat. No. 3,939,375, a special purpose carton is disclosed for shipping sheets or panes of glass which includes corner pads made of shock absorbing, compressible and resilient material, such as polyethylene. Shutting the top panels of the carton compresses the corner pads so as to support the glass sheets at their corners. The use of such corner pads is, however, limited by their size. A certain amount of compression of the interior faces of the pads by the edge of sheet of glass is required to adequately secure the glass pieces, so that if the space between the exterior edges of the glass pane and the interior of the carton is too large, either a smaller carton or larger corner pads must be obtained prior to packaging. Moreover, it is not clear that sufficient compressive forces could be applied to framed pictures and the like to deform the polyurethane material and thereby securely position the article away from the side walls of the outer carton during transportation and handling.

SUMMARY OF THE INVENTION

The present invention provides a novel and improved adjustable packing carton adapted for transporting generally rectilinear articles of various sizes, such as framed pictures. In its broadest sense the invention contemplates a protective shipping container for transporting fragile rectilinear articles which have generally planar front and rear surfaces comprising:

a rectangular carton adapted to enclose the article, resilient material positioned between the walls of the carton and the adjacent front and rear surfaces of the article to cushion and support the surfaces of the article in a spaced apart relation from the carton walls, and segmented, resilient, L-shaped corner inserts, each of the inserts comprising a plurality of detachably connected nested sections forming a pair of essentially perpendicular integral legs, the insert adapted to be securely fitted between the inside corners of the carton and the exterior corners of the article to thereby support the exterior edges of the article.

The carton is formed from one or more pieces of corrugated cardboard which completely enclose the article. The packaged article is securely positioned within and spaced apart from the side walls of the closed carton by sheets or blocks of soft flexible, resilient material, such as polyurethane foam, which cushion and support the front and rear surfaces of the article, and the article is supported at each corner by segmented adjustable L-shaped resilient corner inserts.

Each corner insert is segmented and adjustable in its lateral dimensions along both legs of the L. Thus the size of the corner insert can be adapted at the time the article is packaged to the exterior dimensions of the article being transported to provide a secure fit, so that one carton size can be used to securely package articles of differing sizes for transportation. A handle is provided so that the carton may be easily carried.

The invention also contemplates individual elements which can be assembled in kit form to provide for the shipping or transporting of fragile articles which vary in size. As such, the invention contemplates a packing kit for transporting fragile rectilinear articles of various sizes, the kit being adapted for assembly at the time of the packaging of the article from components comprising:

a rectangular carton adapted to enclose the article to be transported, resilient material adapted to be positioned between the walls of the carton and the adjacent front and rear surfaces of the article to cushion and support the surfaces of the article in a spaced apart relation from the carton walls and segmented, resilient, L-shaped corner inserts comprising a plurality of detachably connected nested sections forming a pair of essentially perpendicular integral legs and adapted to be securely fitted between the inside corners of the carton and the exterior corners of the article to thereby support the exterior edges of the article.

DESCRIPTION OF THE PREFERRED EMBODIMENT

Figure 1:
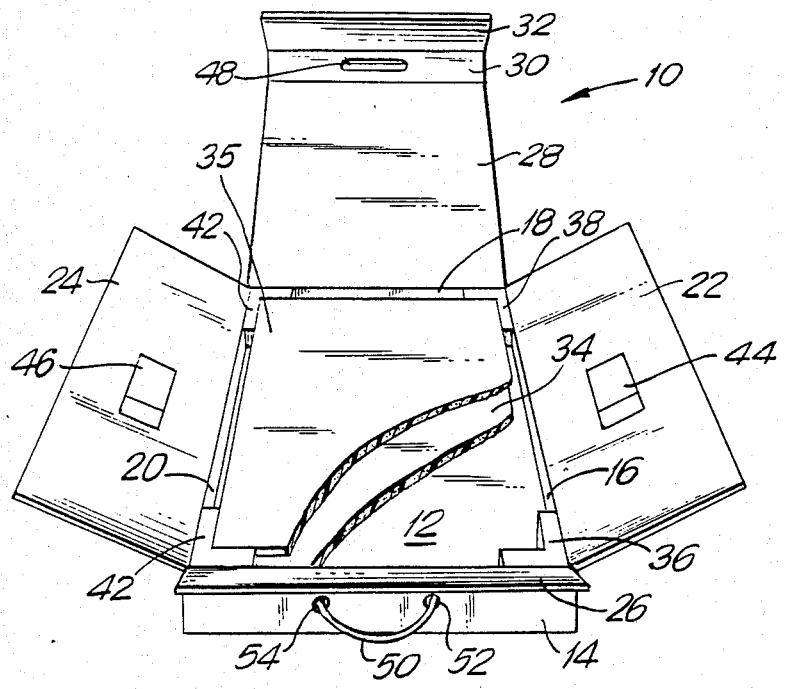
FIG. 1 is a perspective view of one embodiment of the carton of the invention.

Referring to FIG. 1 of the drawings, a perspective view of a carton 10 for transporting rectilinear articles, such as framed pictures, is illustrated. The carton 10 is constructed from corrugated cardboard, which is scored and folded to form a bottom panel 12, side panels 14, 16, 18, 20, side flaps 22 and 24, top flap 26, bottom flap 28, and a first and second extension flap 30 and 32, respectively. The dimensions of cardboard carton 10 may be selected so as to conveniently accommodate the packing of a known or selected range of rectilinear articles within its confines, taking into account the dimensions of the impact absorbing materials required to adequately cushion the largest article to be transported and also taking into account the fragility of the article and the type of conditions likely to be encountered during shipping and handling.

Pad 34 is positioned and preferably secured in the bottom panel 12 of the cardboard carton 10 to cushion the rear surface of the article 35 being transported from shock. The pad 34 is preferably sized such that it covers the entire area of the bottom panel 12. The dimension of pad 34 along sides 14 and 18, therefore, should be somewhat less than the dimensions of the carton along those sides. The pad 34 should be similarly dimensioned along sides 16 and 20. The thickness of the pad 34 should be such that it adequately protects the article 35 being transported from shock. The pad 34 can be constructed from soft flexible and resilient polyurethane foam, although any material that is readily compressible and will adequately cushion the rear surface can be used. In additional embodiments the pad 34 may be adapted to cover an area which is less than the entire bottom panel 12, and may consist of more than one pad, provided the surface of the article being transported is adequately cushioned.

The pad 34 is inserted inside the carton 10 and the article 35 to be transported is set on top of the pad 34. The L-shaped corner inserts 36, 38, 40 and 42 are placed in each corner in the space between the exterior of the article 35 and the interior walls of the carton 10, to provide lateral support during transportation. The inserts can be made of rigid or semi-rigid expanded foam plastic materials well known in the art, such as polyethylene foam, polypropylene foam, expanded polystyrene or PVC foam material. The physical characteristics of the foam material can be determined based upon the weight and configuration of the article to be shipped.

Figure 2A:
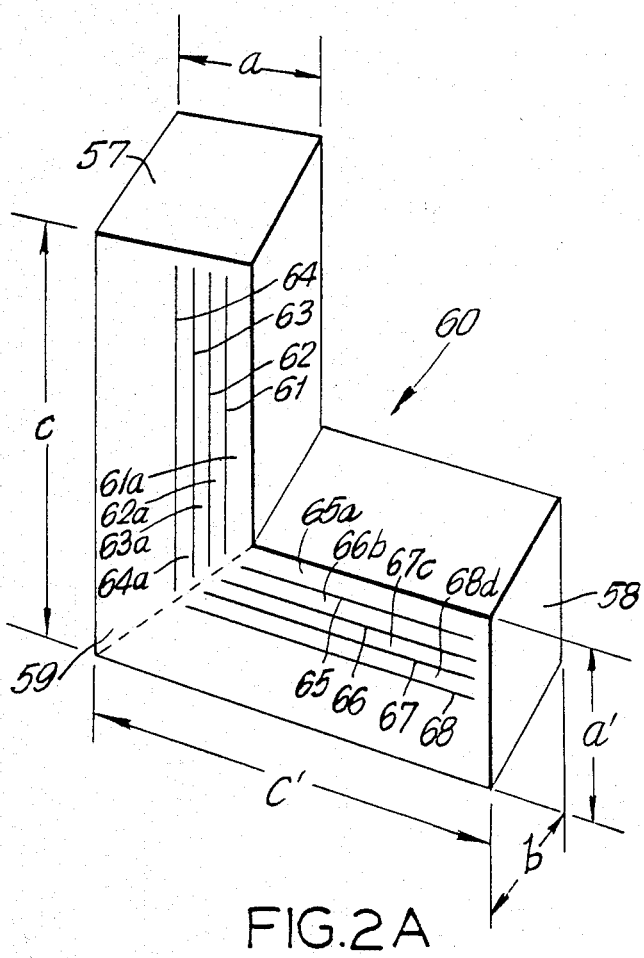
FIG. 2A is a perspective view of one embodiment of a segmented resilient adjustable corner insert of the invention.

Referring to FIG. 2A of the drawings, a corner insert 60, in accordance with a preferred embodiment of the invention, is illustrated in greater detail. The insert 60 can be fabricated from a solid, L-shaped piece of resilient material which is partially pre-cut at regular intervals along lines 61–64 and 65–68 so as to form nested sections 61*a*–64*a* and 65*a*–68*a* along each leg of the insert 60. Each of the pre-cuts along lines 61–68, is made through the entire height of the insert 60 in the direction indicated by b. A small portion of the insert 60 remains uncut at both ends 57 and 58, so that the segmented insert 60 remains intact until it is to be utilized, thereby providing an L-shaped article of nested, detachably joined sections for use at the time of packaging. A small portion of the insert 60 along diagonal line 59 can also be left uncut to provide additional strength.

When an article is presented for shipment, an appropriate sized carton with interior dimensions slightly greater than the exterior dimensions of the article is selected, and the corner inserts 60 are tested for fit. If necessary, sections of each corner insert 60 are removed from either or both legs so that the insert 60 fits snugly into the space between the exterior of the article 35 and the interior walls of the carton 10, thereby providing lateral support at the corners of the article 35. This adjustability allows articles 35 of various sizes to be quickly packaged for transportation with previously manufactured devices.

In another embodiment of the invention, the corner inserts of FIG. 2A may be configured with a number of individual L-shaped sections which are detachably secured to each other to form the nested supports. Sections are removed until the insert 60 fits snugly into the space between the exterior of the article 35 and the interior walls of the carton 10. The individual L-shaped sections can be glued together with a releasable adhesive to hold them in place.

Figure 2B:
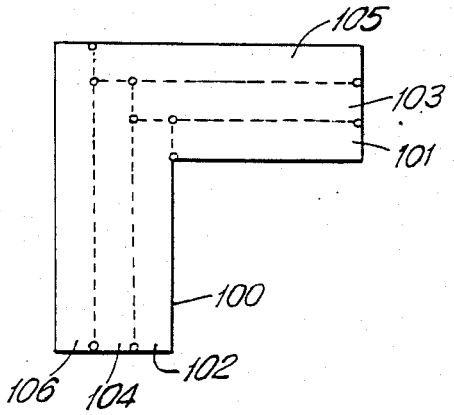
FIG. 2B is a plan view of a segmented corner insert illustrating an alternative configuration of the segmented sections.

In another embodiment of the invention, the corner inserts can be configured with a number of individual rectangular sections. Referring to FIG. 2B of the drawings, a corner insert 100 formed from a plurality of pre-cut nested rectangular sections 101–106, is illustrated. Each of the sections 101–106 can be detachably connected by keeping small portions of the pre-cut insert attached at each corner of each section 101–106. Alternatively, the insert 100 can be formed from individual rectangular sections of resilient material which are glued together with a releasable adhesive to hold them in place. The corner insert 100 is adjusted in size to the exterior of the article 35 by removing successive nested rectangular sections. Other configurations featuring detachably connected nested sections which form an adjustable L-shaped corner insert are possible.

The inserts 60, should have widths a and a′, height b and lengths c and c′, which are sufficient to support the article 35 being transported. These dimensions are adjusted at the time of manufacture according to the weight and size of the range of articles 35 to be transported. Additionally, the spacing of adjacent slits may be adjusted to accommodate a varying range of articles 35.

Referring to FIG. 1 of the drawings, the supporting pads 44 and 46 are preferably adhesively adhered to the interior of the side flaps 22 and 24, respectively, to support the front surface of the article 35. The pads 44 and 46 must have sufficient thickness to adequately support the front surface of the article 35 when the flaps 22 and 24 are closed. The side flaps 22 and 24, in accordance with the embodiment illustrated, have a length in the direction of sides 14 and 18 equal to one-half the length of those sides. When side flaps 22 and 24 are closed, the pads 44 and 46 are compressed against the surface of the article 35 to support it from impact. The pads 44 and 46 are preferably made from a soft flexible resilient polyurethane foam.

The top flap 26 is of sufficient length to hold the side flaps 22 and 24 in place when closed over side flaps 22 and 24. The bottom flap 28, however, has the same dimension as bottom panel 12, so that it covers side flaps 22 and 24 as well as top flap 26 when closed. The extension flap 30 is then folded over side 14 and the plastic handle 50, extending from holes 52 and 54 in the side panel 14, is inserted through the oblong hole 48 in the extension flap 30, so that the carton 10 is easily carried. The second extension flap 32 is further folded over such that it comes in contact with the bottom of the carton 10. It may then be taped, glued or stapled to secure the structure.

Figure 3:
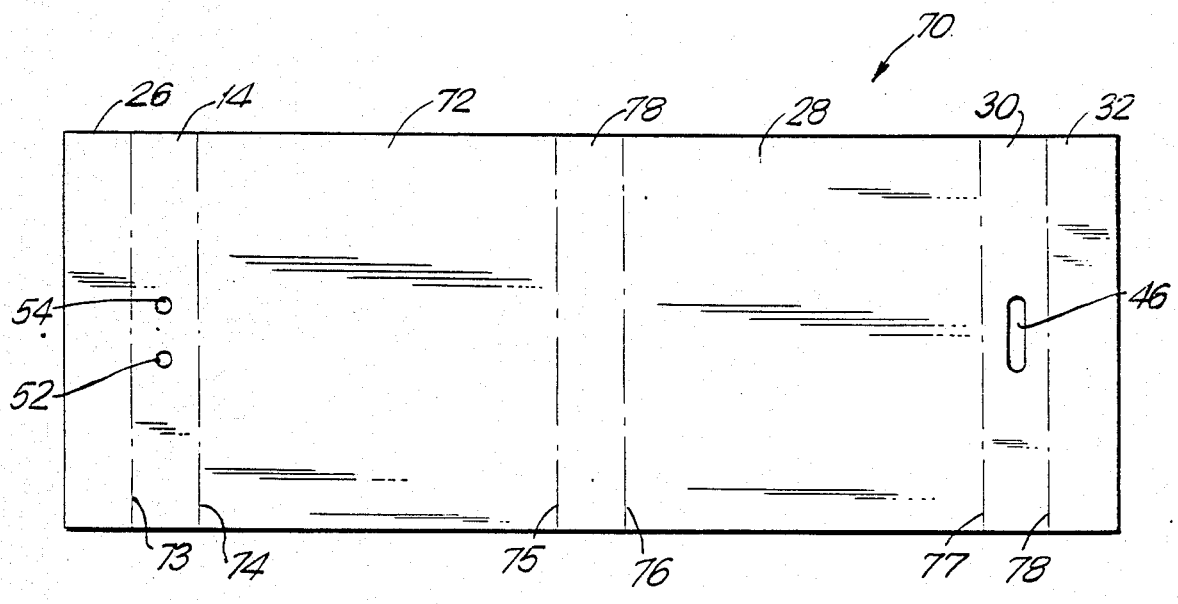
FIG. 3 is a plan view of a first section of cardboard for use in constructing a preferred embodiment.

In the preferred embodiment, the carton 10 is constructed from two rectangular sections of cardboard 70 and 80. Referring to FIG. 3 of the drawings, the first section 70 is shown. It is scored and folded along lines 73 through 78 to form seven sections, which include a bottom 72, sides 14 and 18, top flap 26, bottom flap 28, and extension flaps 30 and 32, where said identifying numbers correspond to those in FIG. 1. The holes 52 and 54 are cut into the side 14 to accommodate the insertion of the plastic handle. The hole 46 is cut into the extension flap 30 such that the plastic handle may be inserted through the hole when the flaps are closed, as previously discussed.

Figure 4:
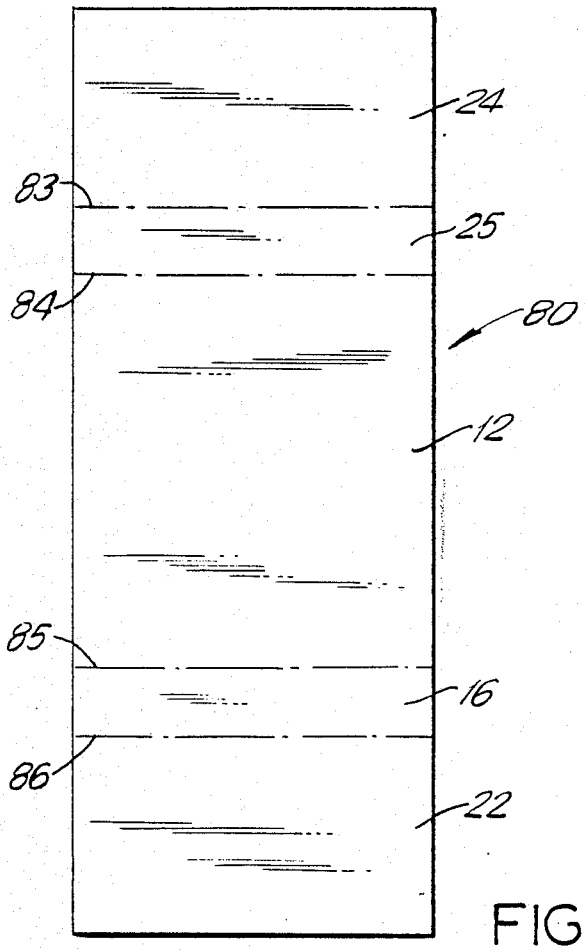
FIG. 4 is a plan view of a second section of cardboard for use in constructing a preferred embodiment.

Referring to FIG. 4 of the drawings, the second rectangular section of cardboard 80 is shown. It is scored along lines 83 through 86 to form five sections, which include bottom 12, sides 16 and 20 and side flaps 22 and 24.

Figure 5:
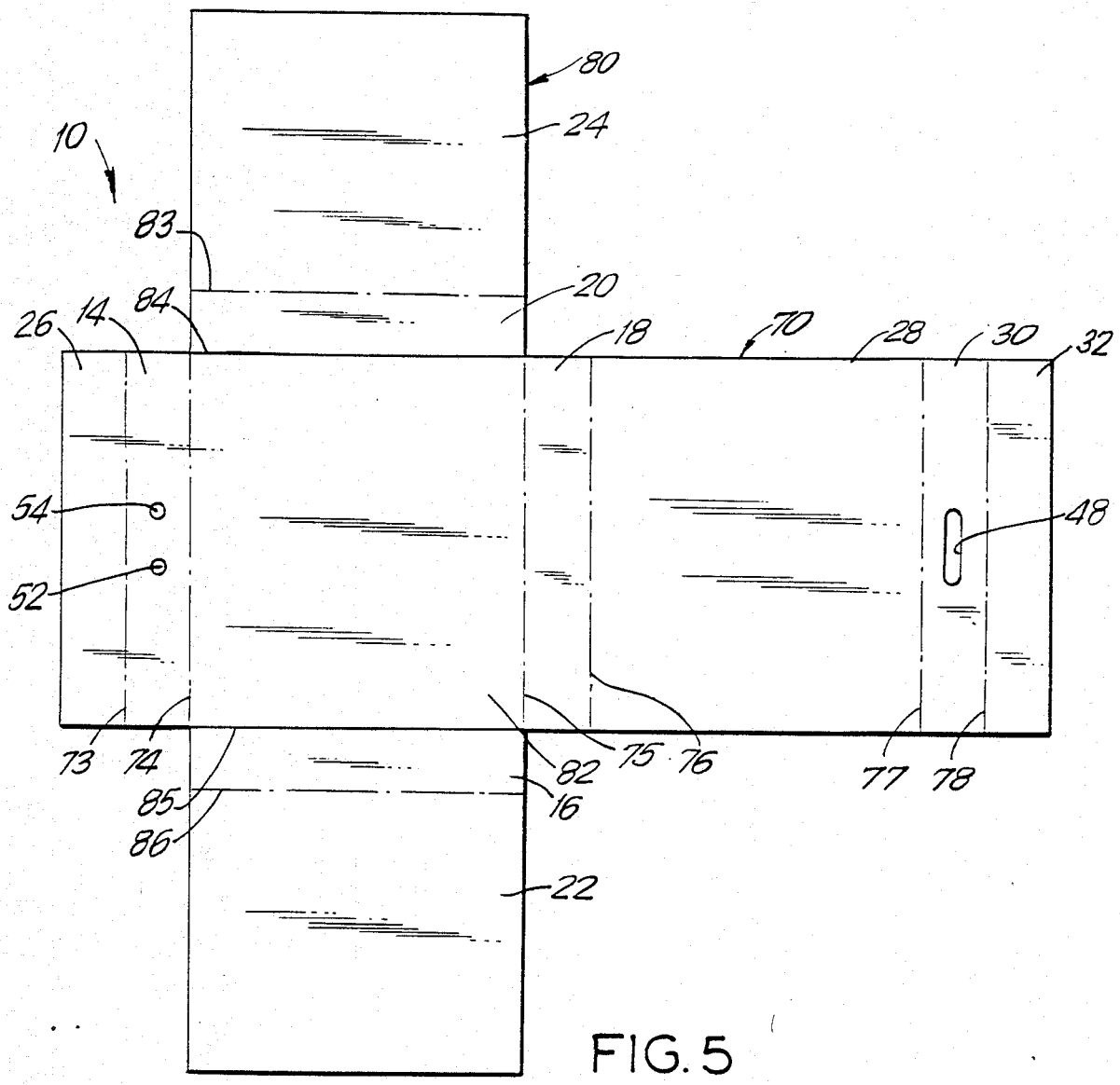
FIG. 5 is a plan view illustrating the assembly of the first and second sections of cardboard of FIGS. 3 and 4.

The two cardboard sheets 70 and 80 are then mated to construct the carton 10 as shown in FIG. 5. Sheet 80 is positioned over sheet 70 so that section 12 is over section 72. All the side panels 14, 16, 18 and 20 are folded up and taped to form the carton 10. The side flaps 22 and 24 are then closed and locked in place by closing the flaps 26, 28, 30 and 32, as previously described.

In another preferred embodiment, the carton 10 may be formed from a single sheet of cardboard of the shape shown in FIG. 5, by scoring along the lines 73 through 78 as well as the lines 83 through 86. Other arrangements and materials suitable for enclosing rectilinear articles are known to the art, and can be utilized to form the carton.

Figure 6:
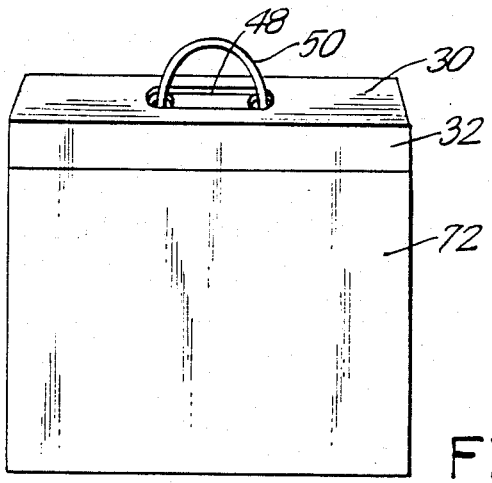
FIG. 6 is a perspective view of the assembled carton.

Referring to FIG. 6 of the drawings, an assembled carton for transporting rectilinear articles is shown. The first extension flap 30 has been folded over side panel 14 such that plastic handle 50 extends through the oblong hole 48 which has been cut into the extension flap 30. The second extension flap 32 is folded over and taped to the exterior of panel 72 of the first cardboard section 70.

I claim:

1. A universal protective shipping container for transporting fragile rectilinear articles of various sizes which have generally planar front and rear surfaces comprising:

a rectangular carton adapted to enclose the article, resilient material positioned between the walls of the carton and the adjacent front and rear surfaces of the article to cushion and support the surfaces of the article in a spaced apart relation from the carton walls, and segmented, resilient, L-shaped corner inserts, each of the inserts comprising a plurality of readily detachable nested sections forming a pair of essentially perpendicular integral legs, the inserts adapted to be modified in size to be securely fitted between the inside corners of the carton and the exterior corners of the article to thereby support the exterior edges of the article.

2. The protective shipping container of claim 1 in which each of the nested sections comprising the corner inserts is L-shaped.

3. The protective shipping container of claim 1 in which each of the nested sections comprising the corner insert is rectangular.

4. The protective shipping container of claim 1 in which each of the corner inserts is fabricated from a solid piece of resilient material which is at least partially pre-cut to facilitate removal of individual nested sections.

5. The protective shipping container of claim 4, in which each of the corner inserts is pre-cut at regular intervals.

6. The protective shipping container of claim 2, in which each of the corner inserts consist of a plurality of individual L-shaped sections which are bonded together with a releasable adhesive.

7. The protective shipping container of claim 3, in which each of the corner inserts consist of a plurality of individual rectangular sections which are bonded together with a releasable adhesive.

8. The protective shipping container of claim 1, in which the corner inserts are fabricated from an expanded plastic foam material.

9. The protective shipping container of claim 8, in which the plastic material is selected from the group consisting of polystyrene, polypropylene, polyethylene, PVC and polyurethane.

10. The protective shipping container of claim 1, in which the carton has a planar bottom, four upstanding sides and a planar top.

11. The protective shipping container of claim 8, in which the carton is constructed from corrugated cardboard.

12. The protective shipping container of claim 10, in which the resilient material positioned between the walls of the carton and the adjacent front and rear surfaces of the article comprises at least one resilient pad for each of the front and rear surfaces of the article.

13. The protective shipping container of claim 12, in which the top of the carton comprises two flaps which fold over to enclose the rectilinear article and a resilient pad is attached to each flap.

14. The protective shipping container of claim 12, in which the resilient pads are flexible polyurethane foam.

15. The protective shipping container of claim 10, in which a carrying handle is attached to one side of the carton.

16. A universal packing kit for transporting fragile rectilinear articles of various sizes, the kit adapted for assembly at the time of packaging of the article from components comprising:

a rectangular carton adapted to enclose the article to be transported, resilient material adapted to be positioned between the walls of the carton and the adjacent front and rear surfaces of the article to cushion and support the surfaces of the article in a spaced apart relation from the carton walls, and segmented, resilient, L-shaped corner inserts, each of the inserts comprising a plurality of readily detachable nested sections forming a pair of essentially perpendicular integral legs and adapted to be modified in size to be securely fitted between the inside corners of the carton and the exterior corners of the article to thereby support the exterior edges of the article.

17. The packing kit of claim 16, further comprising a handle adapted to be attached to the carton at one of its edges.

18. The packing kit of claim 16, in which each of the nested sections comprising the corner inserts is L-shaped.

19. The packing kit of claim 16, in which each of the nested sections comprising the corner inserts is rectangular.

20. The packing kit of claim 16, in which each of the corner inserts is fabricated from a solid piece of resilient material which is at least partially pre-cut to facilitate removal of individual nested sections.

21. The packing kit of claim 20, in which each of the corner inserts are pre-cut at regular intervals.

22. The packing kit of claim 18 in which each of the corner inserts consist of a plurality of individual L-shaped sections which are bonded together with a releasable adhesive.

23. The packing kit of claim 16, in which each of the corner inserts are fabricated from an expanded plastic foam material.

24. The packing kit of claim 23, in which the plastic material is selected from the group consisting of polypropylene, polystyrene, polyethylene, PVC and polyurethane.

25. The packing kit of claim 16, in which the resilient material positioned between the walls of the carton and the adjacent front and rear surfaces of the article comprises at least one resilient pad for each of the front and rear surfaces of the article.

26. The packing kit of claim 25, in which the top of the carton comprises two flaps which fold over to enclose the rectilinear article and resilient material is attached to each flap.

27. The packing kit of claim 25, in which each of the pads is flexible polyurethane foam.

28. The packing kit of claim 16, in which the carton is constructed from corrugated cardboard.

* * * * *